US009452524B1

(12) United States Patent
Kao

(10) Patent No.: US 9,452,524 B1
(45) Date of Patent: Sep. 27, 2016

(54) COMPOSITE TOOL HOLDER

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days.

(21) Appl. No.: 14/806,436

(22) Filed: Jul. 22, 2015

(51) Int. Cl.
*B25H 3/06* (2006.01)
*A47F 7/00* (2006.01)
*B25H 3/04* (2006.01)

(52) U.S. Cl.
CPC ..... *B25H 3/06* (2013.01); *A47F 7/0028* (2013.01); *B25H 3/04* (2013.01)

(58) Field of Classification Search
CPC ..... B25H 3/00; B25H 3/003; B25H 3/04; B25H 3/06; A47F 7/0028
USPC ..... 211/70.6; 206/234, 376, 378
See application file for complete search history.

(56) References Cited

U.S. PATENT DOCUMENTS 2,841,289 A * 7/1958 Odlum ..... B25H 3/003 211/70.6
5,368,164 A * 11/1994 Bennett ..... B25H 3/003 206/373
5,535,882 A * 7/1996 Liu ..... B25H 3/003 206/376
6,044,985 A * 4/2000 Kao ..... B25H 3/003 211/70.6
6,145,662 A * 11/2000 Newton ..... B25H 3/06 206/373
6,257,409 B1 * 7/2001 Lin ..... B25H 3/04 206/376
6,283,311 B1 * 9/2001 Lee ..... B25H 3/006 206/377
6,386,363 B1 * 5/2002 Huang ..... B25H 3/003 206/1.5
7,080,733 B2 * 7/2006 Kao ..... B25H 3/04 206/372
7,108,132 B2 * 9/2006 Shih ..... B25H 3/003 206/378
8,317,021 B2 * 11/2012 Christopher ..... B25H 3/022 206/234
8,505,720 B2 * 8/2013 Huang ..... B25H 3/00 206/349
8,813,957 B1 * 8/2014 Kao ..... B25H 3/003 206/378
2001/0001197 A1 * 5/2001 Ramsey ..... B25H 3/06 203/378
2007/0023369 A1 * 2/2007 Lin ..... B25H 3/003 211/70.6
2009/0146032 A1 * 6/2009 Bettenhausen ..... A61B 50/34 248/220.31
2011/0089126 A1 * 4/2011 Hsieh ..... B25H 3/003 211/706.6
2011/0180499 A1 * 7/2011 Sun ..... B25H 3/04 211/70.6
2012/0138553 A1 * 6/2012 Kao ..... B25H 3/06 211/70.6
2012/0267271 A1 * 10/2012 Huang ..... B25H 3/04 206/349
2013/0118938 A1 * 5/2013 Huang ..... B25H 3/00 206/372

FOREIGN PATENT DOCUMENTS

DE 202014106037 * 3/2015 ..... B25H 3/02
GB 2524096 * 9/2015 ..... B25H 3/06

* cited by examiner

*Primary Examiner* — Michael Safavi
(74) *Attorney, Agent, or Firm* — Alleman Hall McCoy Russell & Tuttle LLP

(57) ABSTRACT

A composite tool holder includes a base, a socket set and a hand tool set. The base includes a substrate, a first track formed on the substrate, and a second track formed on the first track. At least one slot is formed through the substrate. The first track includes a sliding slot. The second track includes an engaging slot. The socket set is combined with the base and includes a positioning plate disposed in the engaging slot of the second track and multiple positioning blocks disposed in the sliding slot. The hand tool set is combined with the base and includes a holding component combined with the substrate. The holding component includes a combining portion disposed in one of the at least one slot and a holding portion formed on a top surface. The composite tool holder can store both hand tools and sleeves at the same time.

20 Claims, 11 Drawing Sheets

COMPOSITE TOOL HOLDER

BACKGROUND OF THE INVENTION

1. Field of the Invention

The present invention relates to a holder, specifically to a composite tool holder capable of storing both hand tools and sleeves.

2. Description of the Related Art

A conventional tool holder mainly includes a base and a plurality of movable positioning blocks engaging with the base. A sliding track is formed on a top surface of the base, and each positioning block has a sliding base formed on a bottom of the positioning block for engaging with the sliding track. An inserting portion is formed upward on a top surface of the sliding base of the positioning block, and the inserting portion can be a socket or a hanging rod. When the inserting portion of each positioning block is the socket, the socket can be used for storing a sleeve. Furthermore, when the inserting portion of each positioning block is the hanging rod, a hand tool such as a socket wrench can be hung on the hanging rod.

However, a user mostly needs to use the sleeve and the hand tool at the same time to fasten or unfasten a fastener, such as a bolt or a nut, but the conventional tool holder cannot hold the sleeve and the hand tool at the same time. Oftentimes the user may forget to bring the sleeve or the hand tool, resulting in inconvenience. Moreover, when the user needs to use the sleeve and the hand tool at the same time, the conventional tool holder may cause inconvenience in carrying or storing the sleeve and the hand tool. Therefore, the conventional tool holder needs to be improved.

SUMMARY OF THE INVENTION

The main objective of the present invention is to provide a composite tool holder.

The composite tool holder comprises a base, a socket set and a hand tool set. The base comprises a substrate and a first track. The substrate comprises at least one slot formed through the substrate, and the first track is formed on a side of the substrate. A length of the first track and a length of the substrate are equal. The first track comprises an upper opening and a sliding slot. The upper opening is formed through a top surface of the first track, and the sliding slot is formed in the first track and communicating with the upper opening. The socket set is combined with the base and comprises multiple positioning blocks. Each positioning block is rotatably disposed in the sliding slot and capable of sliding and rotating along the first track. The hand tool set is combined with the base, and the hand tool set comprises at least one holding component. The at least one holding component comprises a combining portion and a holding portion. The combining portion is mounted through the at least one slot of the substrate and comprises a positioning protrusion on an outer surface of the combining portion. The positioning protrusion abuts the substrate. The holding portion is formed on a top surface of the combining portion and disposed above the substrate. The holding portion is for positioning a hand tool on the substrate.

By the above technical features, the composite tool holder of the present invention allows the user to fix and store the sleeve and the hand tool on the base at the same time by means of disposing the socket set and the hand tool set on the base. Therefore, it allows the user to use or store both the sleeve and the hand tool at the same time and prevents the user from forgetting to bring the sleeve or the hand tool. In addition, the structural strength can be enhanced by the bracket sets disposed on two sides of the base, and the user can lift and carry the composite tool holder by holding the two supporting plates. Furthermore, the composite tool holder can be disposed on the metal object by the two magnetic bases. The present invention provides the composite tool holder to store the sleeve and the hand tool at the same time.

Other objectives, advantages and novel features of the invention will become more apparent from the following detailed description when taken in conjunction with the accompanying drawings.

DETAILED DESCRIPTION OF THE INVENTION

Figure 1:
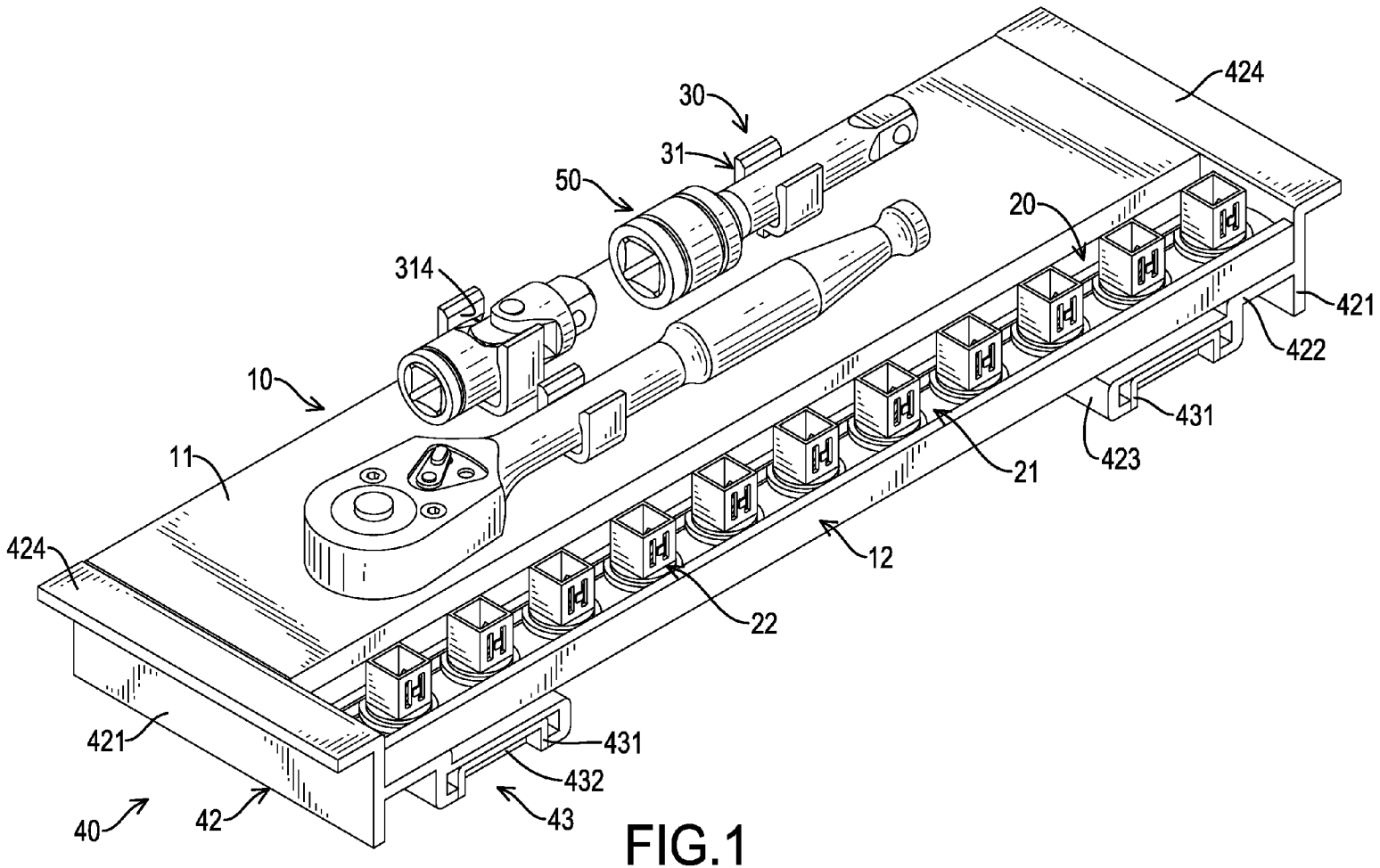
FIG. 1 is a perspective view of a composite tool holder in accordance with a first preferred embodiment of the present invention.
Figure 2:
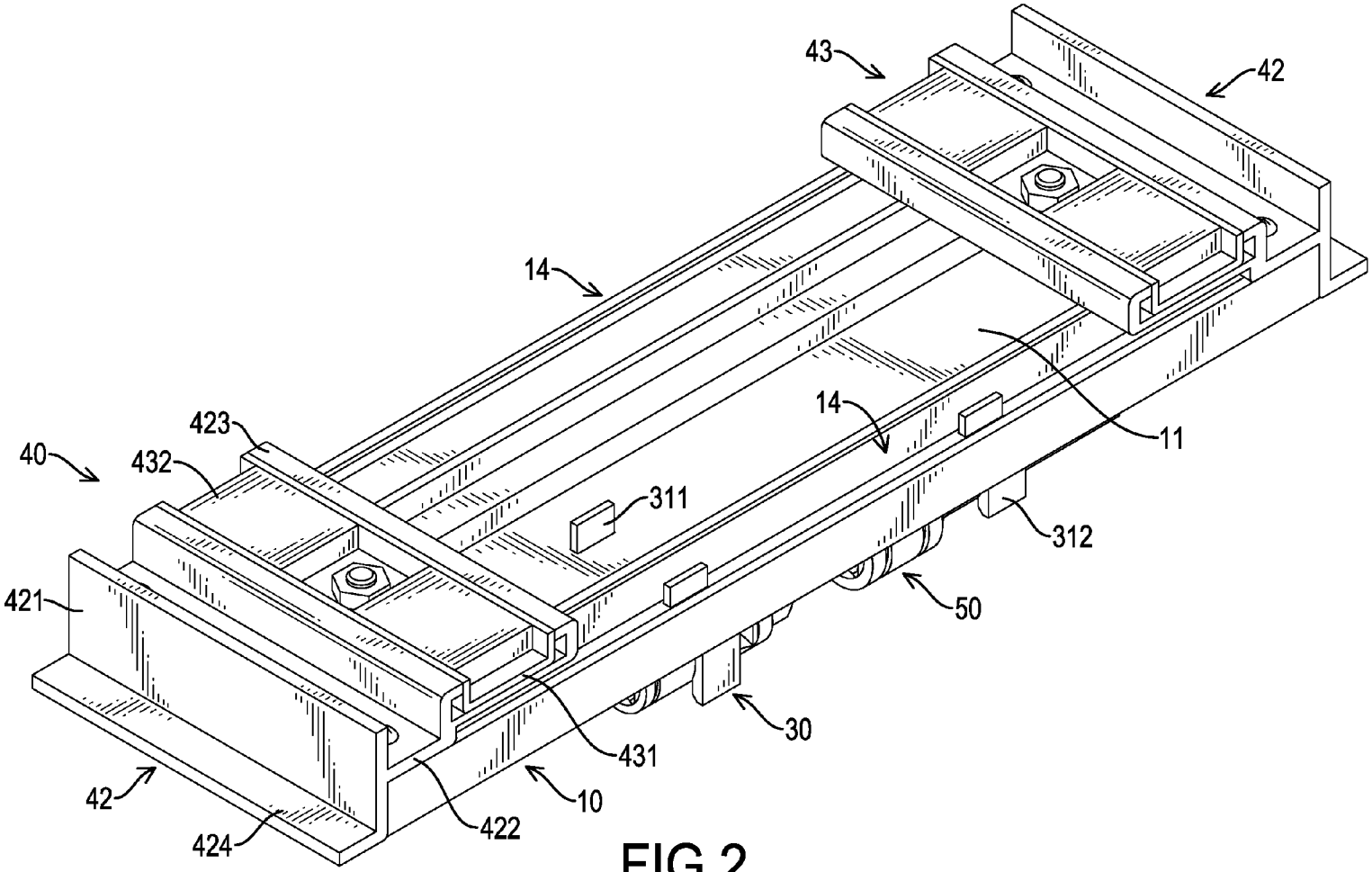
FIG. 2 is another perspective view of the composite tool holder in FIG. 1.
Figure 3:
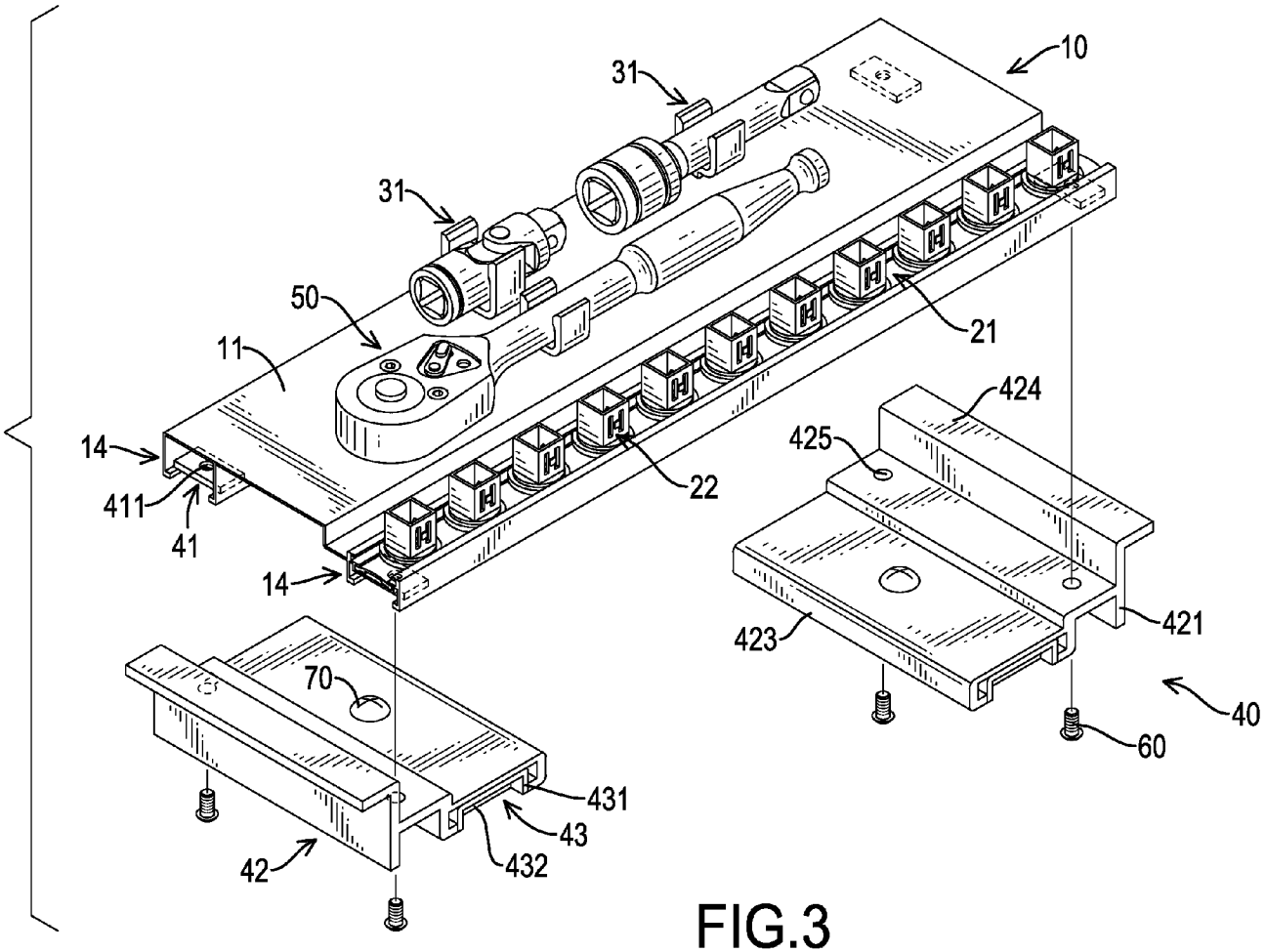
FIG. 3 is an exploded view of the composite tool holder in FIG. 1.

With reference to FIG. 1 to FIG. 3, a first preferred embodiment of a composite tool holder has a base 10, a socket set 20, a hand tool set 30 and a bracket set 40.

With reference to FIG. 3 to FIG. 5B, the base 10 is an extruded aluminum structure and comprises a substrate 11, a first track 12, a second track 13 and two enclosed tracks 14. The substrate 11 is a rectangular plate extending horizontally and includes at least one slot 111. The slot 111 is strip-shaped and formed through a top surface and a bottom surface of the substrate 11. Preferably, the substrate 11 includes three slots 111 spaced apart from each other, and the substrate 11 further includes a receiving hole 112 formed through the top surface and the bottom surface of the substrate 11. The first track 12 is formed on a side of the substrate 11 and a length of the first track 12 and a length of the substrate 11 are equal. Preferably, as shown in FIG. 5A, a height is formed between the first track 12 and the substrate 11. The first track 12 includes an upper opening 121 and a sliding slot 122. The upper opening 121 is formed through a top surface of the first track 12. The sliding slot 122 is formed in the first track 12 and communicates with the upper opening 121. Preferably, as shown in FIG. 5A, a width W1 of the sliding slot 122 is greater than a width W2 of the upper opening 121.

The second track 13 is formed on a bottom of the first track 12, and the second track 13 includes a top opening 131 and an engaging slot 132. The top opening 131 is formed through the bottom of the first track 12 and communicates with the sliding slot 122. Preferably, a width W3 of the top opening 131 is less than the width W1 of the sliding slot 122. The engaging slot 132 is formed in the second track 13 and communicates with the top opening 131. A width W4 of the engaging slot 132 is greater than the width W3 of the top opening 131.

The two enclosed tracks 14 are formed on a bottom of the substrate 11 and the bottom of the first track 12 respectively, and a length of each enclosed track 14, the length of the substrate 11, and the length of the first track 12 are equal. The enclosed track 14 formed on the bottom of the substrate 11 communicates with at least one of the at least one slot 111, and the enclosed track 14 formed on the bottom of the first track 12 covers the second track 13. Each enclosed track includes a lower opening 141 and an enclosed slot 142. The lower opening 141 is formed through a bottom of the enclosed track 14, and the enclosed slot 142 is formed in the enclosed track 14 and communicates with the lower opening 141. Preferably, a width W5 of the lower opening 141 is less than a width W6 of the enclosed slot 142.

Figure 4:
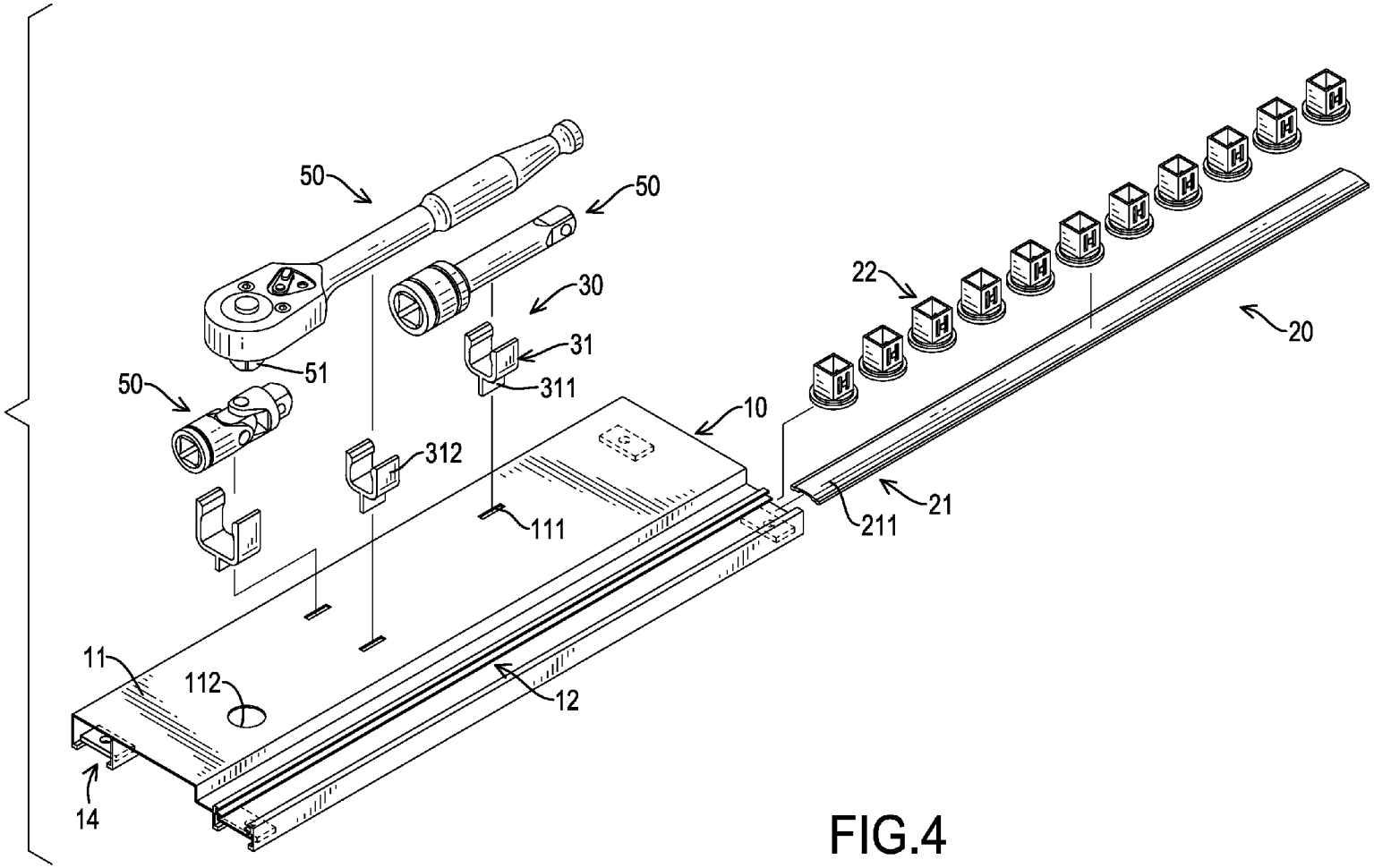
FIG. 4 is another perspective view of the composite tool holder in FIG. 1.
Figure 5B:
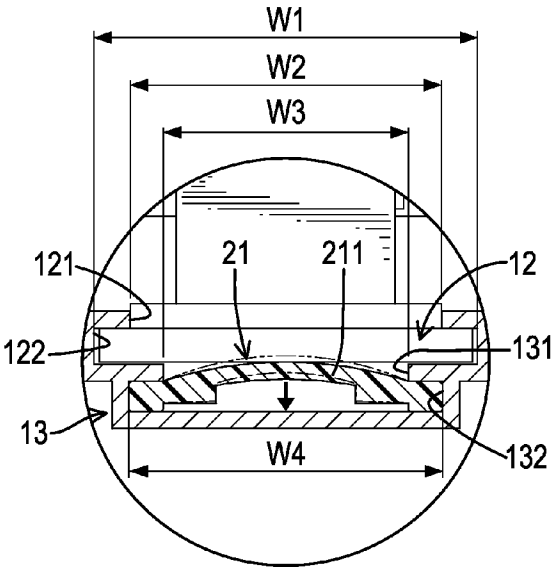
FIG. 5B is a partial enlarged view of FIG. 5A.
Figure 5A:
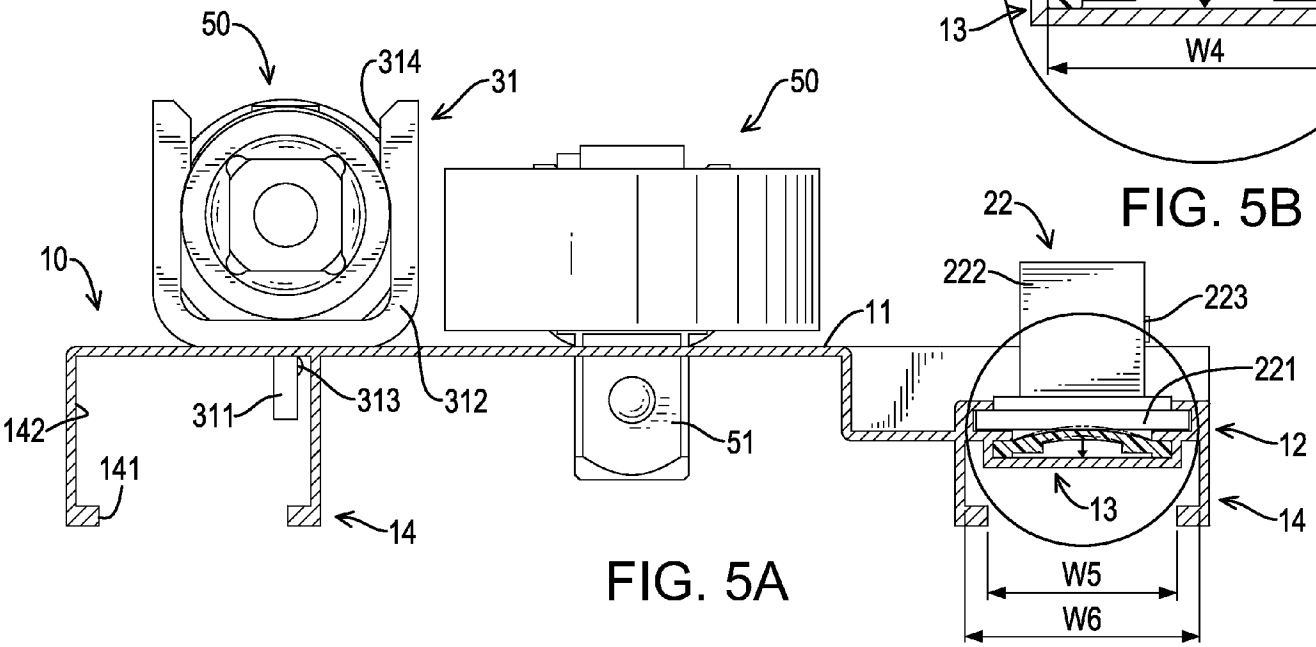
FIG. 5A is a partial cross-sectional view of the composite tool holder in FIG. 1.

With reference to FIG. 4, FIG. 5A and FIG. 5B, the socket set 20 is combined with the base 10 and includes a positioning plate 21 and multiple positioning blocks 22. The positioning plate 21 is a strip-shaped plate with resilience and is disposed in the engaging slot 132 of the second track 13. An arc-shaped abutting portion 211 is formed on a middle of a top surface of the positioning plate 21, and the abutting portion 211 extends along a longitudinal side of the positioning plate 21 and extends into the sliding slot 122 of the first track 12 through the top opening 131. Each positioning block 22 is rotatably disposed in the sliding slot 122 and is capable of sliding and rotating along the first track 12. Each positioning block 22 includes an engaging portion 221 and an inserting portion 222. The engaging portion 221 engages in the sliding slot 122 and abuts the abutting portion 211 of the positioning plate 21. Preferably, the engaging portion 221 of the positioning block 22 can be a circular plate of a flattened structure or a stepped structure. The inserting portion 222 is formed on a top surface of the engaging portion 221 and extends out of the upper opening 121 of the first track 12. The inserting portion 222 includes a resilient constraining protrusion 223 formed on an outer surface of the inserting portion 222, so that sleeve can firmly engage with the inserting portion 222 of the positioning block 22.

Figure 6:
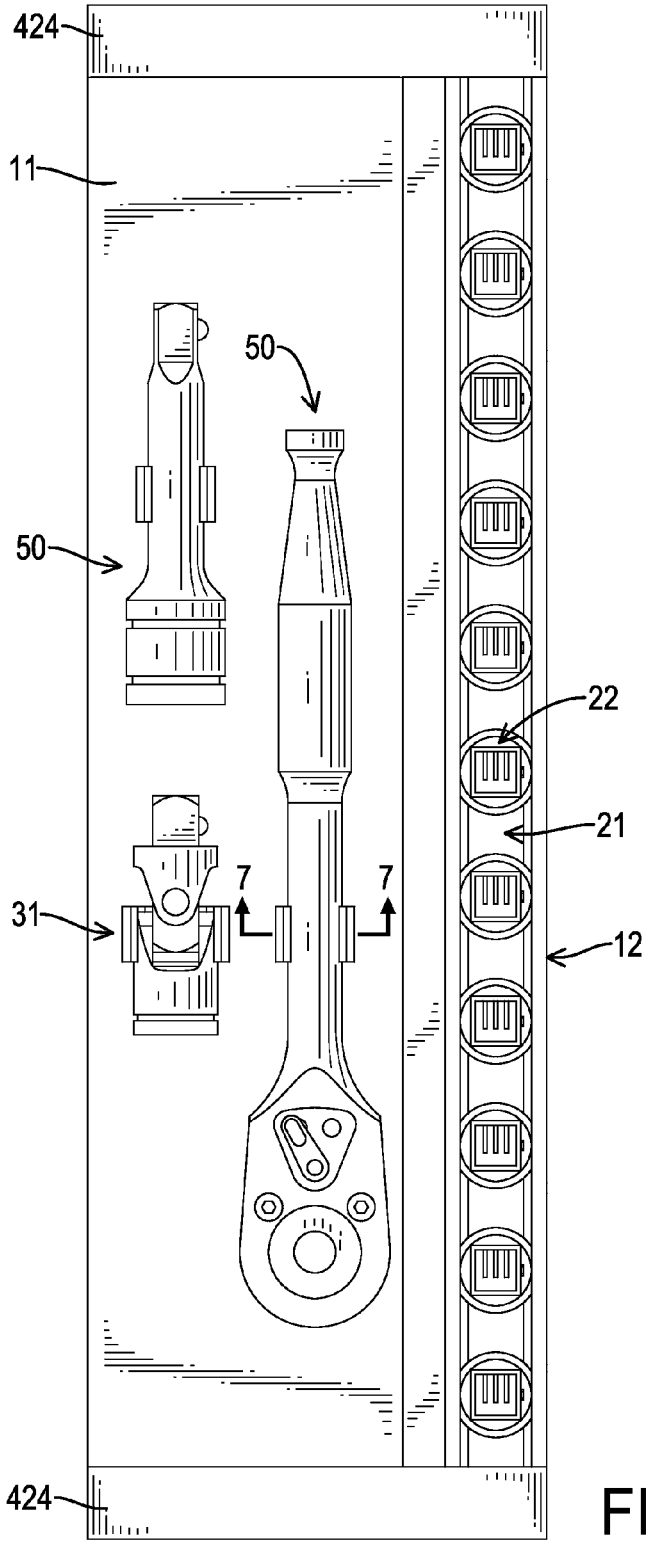
FIG. 6 is a top view of the composite tool holder in FIG. 1.
Figure 7:
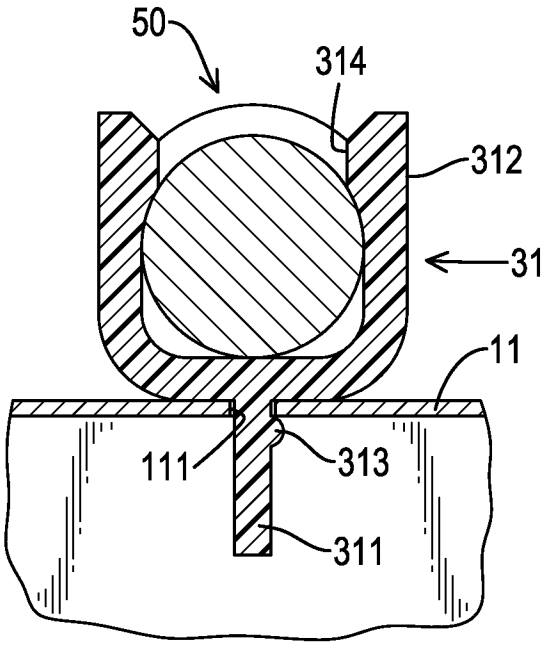
FIG. 7 is a cross-sectional view of the composite tool holder in FIG. 1 along line 7-7 in FIG. 6.

With reference to FIG. 4, FIG. 6 and FIG. 7, the hand tool set 30 is combined with the base 10 and includes at least one holding component 31, each one of the at least one holding component 31 is combined with the substrate 11 and includes a combining portion 311 and a holding portion 312. The combining portion 311 is a plate and is mounted through one of the at least one slot 111 of the substrate 11. The combining portion 311 includes a positioning protrusion 313 abutting the substrate 11 and formed on an outer surface of the combining portion 311, so that the at least one holding component 31 can be firmly disposed on the substrate 11. The holding portion 312 is integrally formed on a top surface of the combining portion 311 and disposed above the substrate 11. The holding portion 312 is U-shaped with resilience, so that the at least one holding component 31 can position a hand tool 50 on the substrate 11. Preferably, the holding portion 312 of the holding component 31 includes two holding protrusions 314 near inner surfaces of two free ends of the holding component 31 respectively. Furthermore, an amount of the at least one holding component 31 of the hand tool set 30 and an amount of the at least one slot 111 are the same. A protrusion 51 of the hand tool 50 can extend to the bottom of the substrate 11 through the receiving hole 112 of the substrate 11, such that the hand tool 50 can be positioned firmly on the substrate 11 by the at least one holding component 31 and the receiving hole 112.

Figure 8:
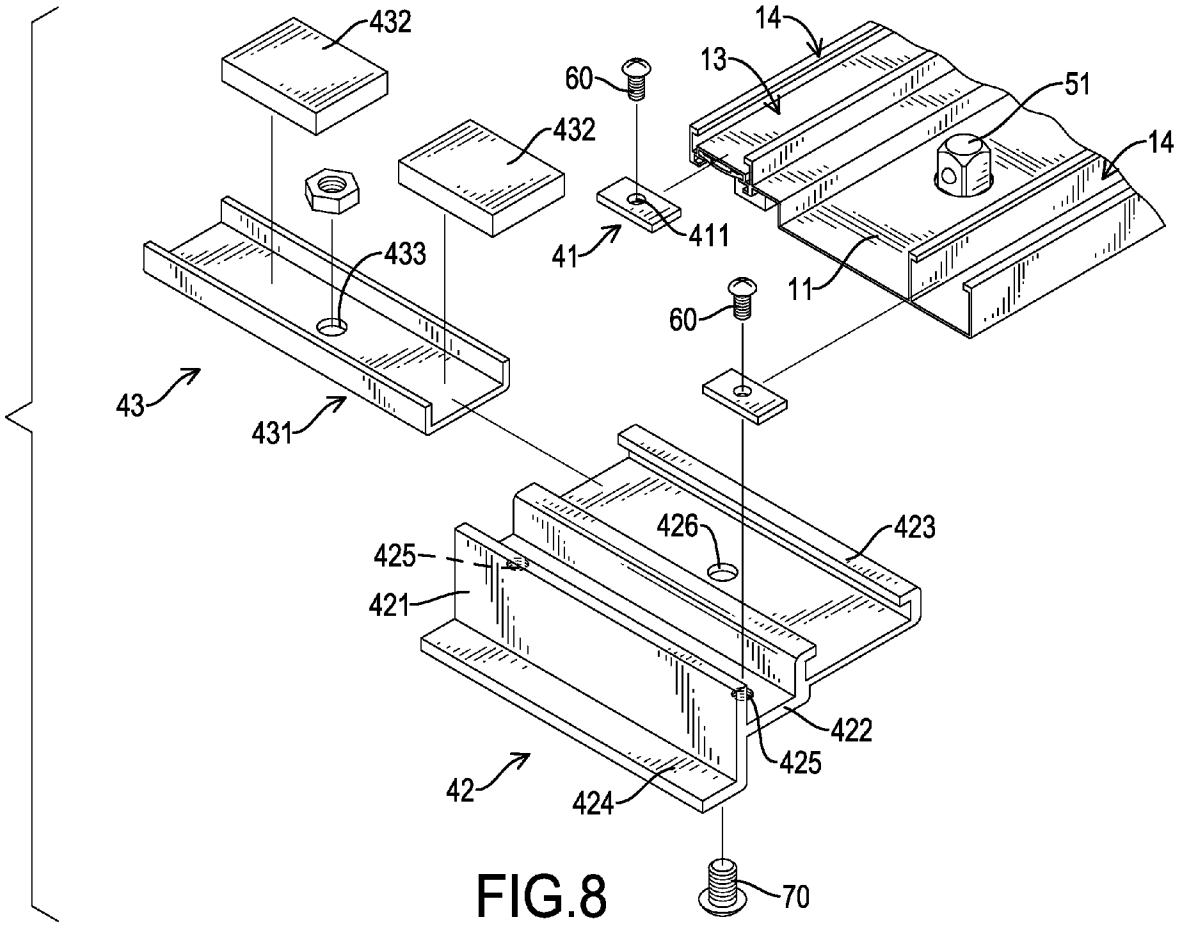
FIG. 8 is another exploded perspective view of the composite tool holder in FIG. 1.
Figure 9:
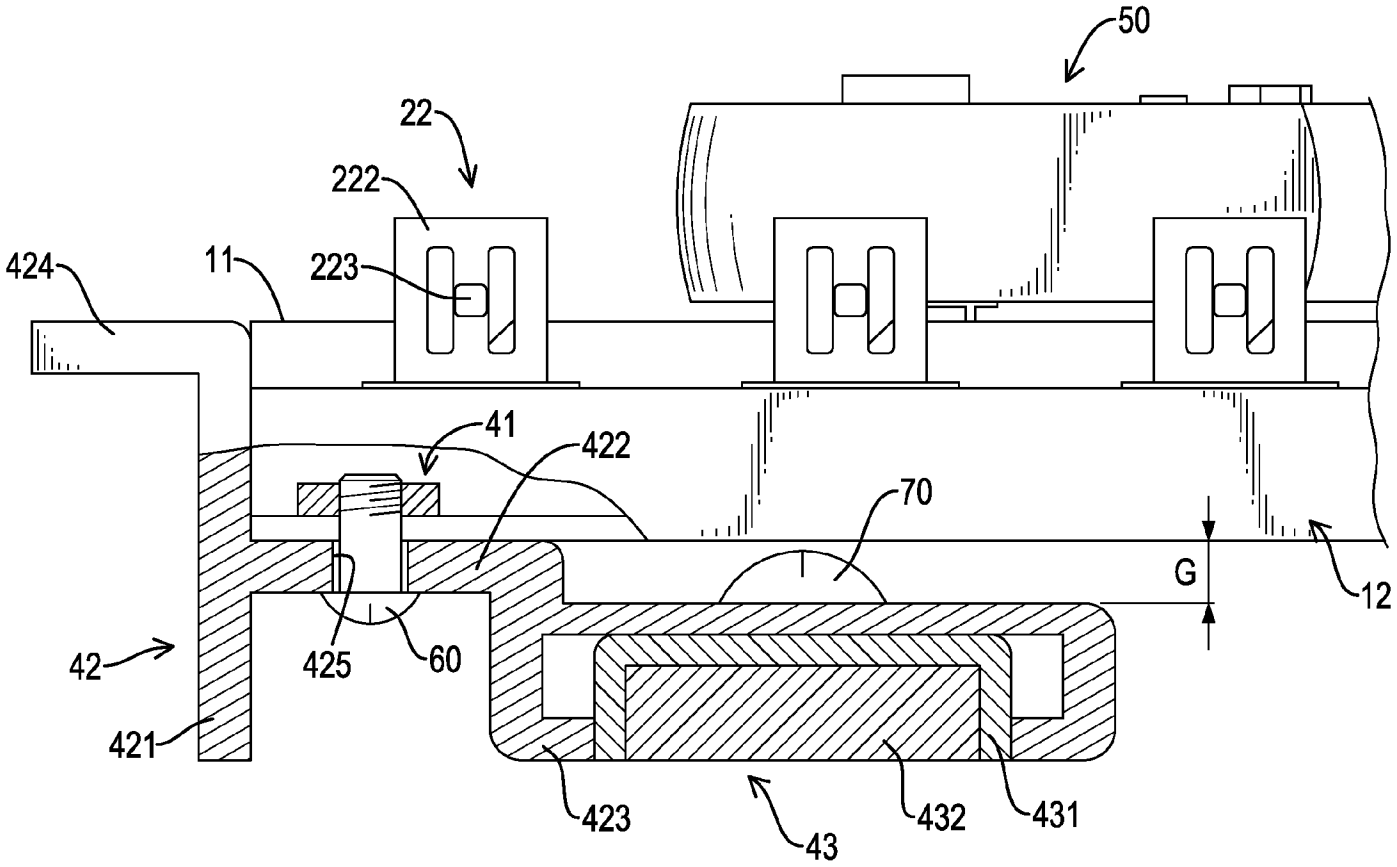
FIG. 9 is a partial sectional view of the composite tool holder in FIG. 1.

With reference to FIG. 2, FIG. 8 and FIG. 9, the bracket set 40 is combined with the base 10 and disposed on two sides of the socket set 20. The bracket set 40 includes multiple fixing plates 41, two supporting bases 42 and two magnetic bases 43. Each of the fixing plates 41 is a rectangular plate and disposed in one of the enclosed tracks 14 and near one side of the substrate 11 or one side of the first track 12. Each of the fixing plates 41 includes a fixing hole 411 formed through the fixing plate 41 and communicating with the lower opening 141 of the corresponding enclosed track 14, so that a fixing component 60 can engage with the fixing plate 41 through the lower opening 141. The two supporting bases 42 are extruded aluminum structures and combined with two sides of the base 10, so as to enclose two sides of the first track 12, two sides of the second track 13, and two sides of each enclosed track 14.

Each supporting base 42 includes an enclosed plate 421, an extending plate 422 and a connecting track 423. The enclosed plate 421 is disposed vertically. The enclosed plate 421 of each supporting base 42 abuts one of the sides of the base, so as to enclose one of the sides of the first track 12, one of the sides of the second track 14 and one of the sides of each enclosed track 14. Furthermore, each supporting base 42 includes a supporting plate 424 horizontally formed on a top of the enclosed plate 421, and the supporting plate 424 is aligned to the substrate 11. Therefore, a user can lift the composite tool holder by holding the two supporting plates 424. The extending plate 422 is formed on the enclosed plate 421 horizontally and formed on a side of the enclosed plate 421 different from a side of the enclosed plate 421 on which the supporting plate 424 is formed. The extending plate 422 is disposed under the base 10. The extending plate 422 includes two holes 425 formed through the extending plate 422 and spaced apart from each other, so that two fixing components 60 can be mounted through the two holes 425 to engage with the two fixing plates 41 respectively. As a result, the supporting base 42 can be disposed on the side of the base 10 by engagement of the two fixing components 60 and the two fixing plates 41. The connecting track 423 is formed on a bottom of the extending plate 422 and is distal from the enclosed plate 421. Furthermore, the connecting track 423 includes a through hole 426 formed through a middle portion of a bottom surface of the connecting track 423. Preferably, a gap G is formed between the connecting track 423 and the base 10.

The two magnetic bases 43 are combined with the two supporting bases 42 respectively and are disposed under the base 10. Each magnetic base 43 includes a combining frame 431 and at least one magnetic block 432. The combining frame 431 is U-shaped and is fixed in the connecting track 423 of the supporting base 42. The combining frame 431 includes a combining hole 433 aligned to the through hole 426 of the connecting track 423, so that the combining frame 431 is fastened to the connecting track 423 by a fastening component 70 mounted through the combining hole 433 and the corresponding through hole 426. The at least one magnetic block 432 is fixed on a bottom of the combining frame 431 for attaching to metal objects, so that the composite tool holder can be disposed on a metal object, such as a tool cabinet, by the two magnetic bases 43. Preferably, each magnetic base 43 includes two magnetic blocks 432 on two sides of the combining hole 433.

With reference to FIG. 1, FIG. 5A and FIG. 5B, when the first preferred embodiment of the invention is in use, the user can engage the sleeve with the inserting portion 222 of one of the positioning blocks 22 of the socket set 20, and the sleeve can be firmly disposed on the positioning block 22 by the constraining protrusion 223. The user can apply a force to the sleeve to drive the positioning block 22 to rotate relative to the positioning plate 21, so that a size mark on an outer surface of the sleeve is rotated to face the user for ease of retrieving and identifying the hand tool. The engaging portion 221 of each positioning block 22 abuts the abutting portion 211 of the positioning plate 21, so that after the user rotates or slides the sleeve, the positioning block 22 and the positioning plate 21 abut each other and are firmly disposed in the first track 12. Therefore, the sleeve on the positioning block 22 does not rotate or slide relative to the first track 12. That is, the sleeve can be firmly disposed on the base 10.

With reference to FIG. 4, FIG. 5A and FIG. 7, the user can position the hand tool 50 on the substrate 11 by the two holding protrusions 314 of the holding component 31 of the hand tool set 30, and the hand tool 50 can cooperate with the sleeve mounted on the positioning block 22. The hand tool 50 includes the protrusion 51 extending to the bottom of the substrate 11 through the receiving hole 112 of the substrate 11. In addition, the hand tool 50 can be positioned on the substrate 11 by the holding component 31 and the receiving hole 112. Furthermore, as shown in FIG. 1 and FIG. 2, after positioning the sleeve and the hand tool 50 on the base 10 by the socket set 20 and the hand tool set 30, the sleeve and the hand tool 50 disposed on the base 10 can be fixed on the metal object, such as the tool cabinet, by a magnetic force between the bracket set 40 and the two magnetic bases 43. The invention achieves the function of storing the sleeve and the hand tool 50 at the same time to facilitate convenience in use and prevent the user from forgetting to bring the sleeve or the hand tool 50.

Figure 10:
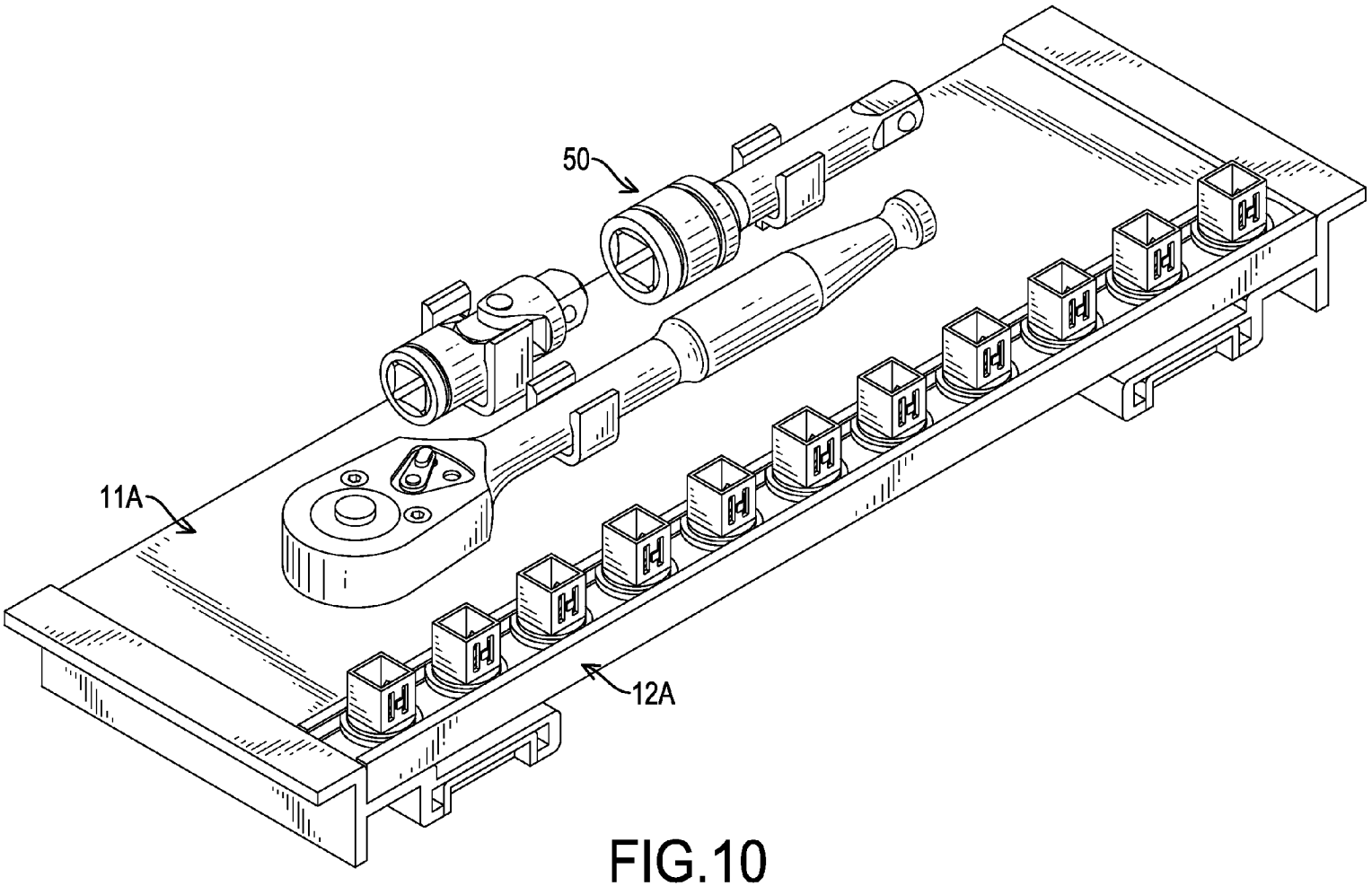
FIG. 10 a perspective view of the composite tool holder in accordance with a second preferred embodiment of the present invention.
Figure 11:
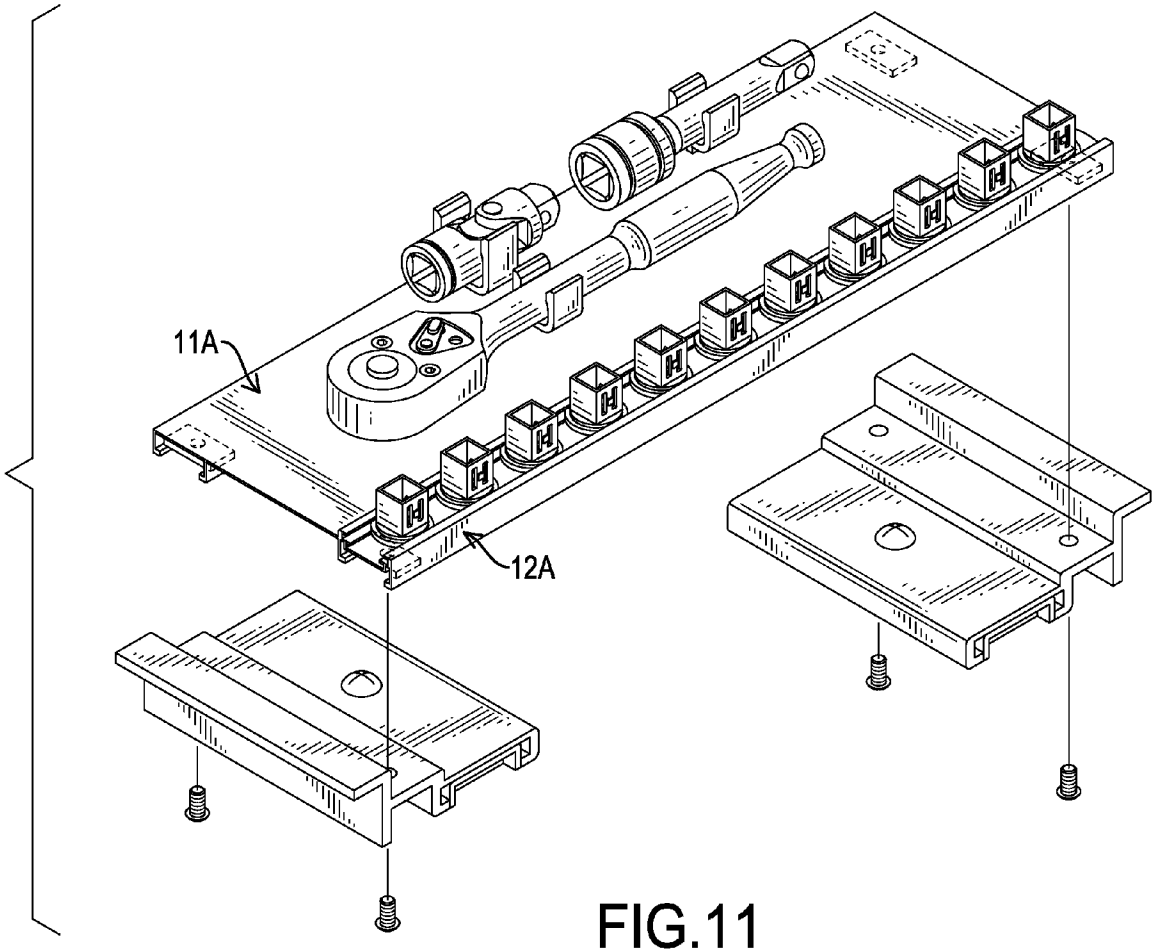
FIG. 11 is an exploded view of the composite tool holder in FIG. 10.

FIG. 9 and FIG. 10 show a second preferred embodiment. The second preferred embodiment is similar with the first preferred embodiment, and a difference between the two embodiments is that a first track 12A and a substrate 11A are at a same horizontal level, so there is no height formed between the first track 12A and the substrate 11A.

By the above technical features, the composite tool holder of the invention allows the user to fix and store the sleeve and the hand tool 50 on the base 10 at the same time by disposing the socket set 20 and the hand tool set 30 on the base 10. Therefore, it allows the user to use or store the sleeve and the hand tool 50 at the same time and prevents the user from forgetting to bring the sleeve or the hand tool 50. In addition, the structural strength can be enhanced by the bracket sets 40 disposed on two sides of the base 10, and the user can carry the composite tool holder by holding the two supporting plates 424. Furthermore, the composite tool holder can be disposed on the metal object by the two magnetic bases 43. The invention provides the composite tool holder to store the sleeve and the hand tool 50 at the same time.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A composite tool holder comprising:

a base comprising:

a substrate comprising at least one slot formed through the substrate; and a first track formed on a side of the substrate, a length of the first track and a length of the substrate being equal, the first track comprising:

an upper opening formed through a top surface of the first track; and a sliding slot formed in the first track and communicating with the upper opening;

a socket set combined with the base and comprising:

multiple positioning blocks, each positioning block rotatably disposed in the sliding slot and capable of sliding and rotating along a longitudinal side of the first track; and a hand tool set combined with the base, the hand tool set comprising:

at least one holding component combined with the substrate, each one of the at least one holding component comprising:

a combining portion mounted through one of the at least one slot of the substrate and comprising:

a positioning protrusion formed on an outer surface of the combining portion and abutting the substrate; and a holding portion formed on a top surface of the combining portion and disposed above the substrate for positioning a hand tool on the substrate.

2. The composite tool holder as claimed in claim 1, wherein the base comprises:

a second track formed on a bottom of the first track and comprising:

a top opening formed through the bottom of the first track and communicating with the sliding slot;

an engaging slot formed in the second track and communicating with the top opening; and the socket set comprises:

a positioning plate disposed in the engaging slot of the second track and comprising:

an arc-shaped abutting portion formed on a middle of a top surface of the positioning plate, the abutting portion extending along a longitudinal side of the positioning plate and extending into the sliding slot of the first track through the top opening, and the abutting portion abutting a bottom of each positioning block.

3. The composite tool holder as claimed in claim 1, wherein a height is formed between the first track and the substrate.

4. The composite tool holder as claimed in claim 2, wherein a height is formed between the first track and the substrate.

5. The composite tool holder as claimed in claim 1, wherein the first track and the substrate are at a same horizontal level.

6. The composite tool holder as claimed in claim 2, wherein the first track and the substrate are at a same horizontal level.

7. The composite tool holder as claimed in claim 1, wherein the base further comprises:

two enclosed tracks formed on a bottom of the substrate and a bottom of the first track respectively; a length of each enclosed track, the length of the substrate, and the length of the first track being equal; the enclosed track that is formed on the bottom of the substrate communicating with at least one of the at least one slot; the enclosed track that is formed on the bottom of the first track covering the second track; each enclosed track comprising:

a lower opening formed through a bottom of the enclosed track; and an enclosed slot formed in the enclosed track and communicating with the lower opening.

8. The composite tool holder as claimed in claim 4, wherein the base further comprises:

two enclosed tracks formed on a bottom of the substrate and a bottom of the first track respectively; a length of each enclosed track, the length of the substrate, and the length of the first track being equal; the enclosed track that is formed on the bottom of the substrate communicating with at least one of the at least one slot; the other enclosed track that is formed on the bottom of the first track covering the second track; each enclosed track comprising:

a lower opening formed through a bottom of the enclosed track; and an enclosed slot formed in the enclosed track and communicating with the lower opening.

9. The composite tool holder as claimed in claim 7, further comprising a bracket set combined with the base and disposed on two sides of the socket set, the bracket set comprising:

multiple fixing plates, each of the fixing plates slidably disposed in one of the enclosed tracks and disposed near one side of the substrate or one side of the first track, each of the fixing plates comprising:

a fixing hole formed through the fixing plate and communicating with the lower opening of the corresponding enclosed track for accommodating a fixing component fastened with the fixing plate through the lower opening; and two supporting bases combined with two sides of the base respectively, so as to enclose two sides of the first track, two sides of the second track, and two sides of each enclosed track.

10. The composite tool holder as claimed in claim 8, further comprising a bracket set combined with the base and disposed on two sides of the socket set, the bracket set comprising:

multiple fixing plates, each of the fixing plates slidably disposed in one of the enclosed tracks and disposed near one side of the substrate or one side of the first track, each of the fixing plates comprising:

a fixing hole formed through the fixing plate and communicating with the lower opening of the corresponding enclosed track, for accommodating a fixing component fastened with the fixing plate through the lower opening; and two supporting bases combined with two sides of the base respectively, so as to enclose two sides of the first track, two sides of the second track, and two sides of each enclosed track.

11. The composite tool holder as claimed in claim 9, wherein each supporting base comprises:

an enclosed plate disposed vertically and abutting a side of the base, the enclosed plate comprising:

a supporting plate horizontally formed on a top of the enclosed plate and aligned to the substrate;

an extending plate horizontally formed on the enclosed plate and formed on a side of the enclosed plate different from a side of the enclosed plate on which the supporting plate is formed, the extending plate being disposed under the base and comprising:

two holes formed through the extending plate and spaced apart from each other for accommodating two fixing components mounted through the two holes to be fastened with the two fixing plates respectively; and a connecting track formed on a bottom of the extending plate and being distal from the enclosed plate, the connecting track comprising a through hole formed through a middle portion of a bottom surface of the connecting track.

12. The composite tool holder as claimed in claim 10, wherein each supporting base comprises:

an enclosed plate disposed vertically and abutting a side of the base, the enclosed plate comprising:

a supporting plate horizontally formed on a top of the enclosed plate and aligned to the substrate;

an extending plate horizontally formed on the enclosed plate and formed on a side of the enclosed plate different from a side of the enclosed plate on which the supporting plate is formed, the extending plate being disposed under the base and comprising:

two holes formed through the extending plate and spaced apart from each other for accommodating two fixing components mounted through the two holes to be fastened with the two fixing plates respectively; and a connecting track formed on a bottom of the extending plate and being distal from the enclosed plate, the connecting track comprising a through hole formed through a middle portion of a bottom surface of the connecting track.

13. The composite tool holder as claimed in claim 11, wherein the bracket set comprises two magnetic bases combined with the two supporting bases respectively and disposed under the base, and each of the magnetic bases comprises:

a combining frame fixed in the connecting track of the supporting base, the combining frame comprising a combining hole aligned to the through hole of the connecting track, so that the combining frame is fastened to the connecting track by a fastening component mounted through the combining hole and the through hole; and at least one magnetic block fixed on a bottom of the combining frame.

14. The composite tool holder as claimed in claim 12, wherein the bracket set comprises two magnetic bases combined with the two supporting bases respectively and disposed under the base, and each of the magnetic bases comprises:

a combining frame fixed in the connecting track of the supporting base, the combining frame comprising a combining hole aligned to the through hole of the connecting track, so that the combining frame is fastened to the connecting track by a fastening component mounted through the combining hole and the through hole; and at least one magnetic block fixed on a bottom of the combining frame.

15. The composite tool holder as claimed in claim 1, wherein the substrate comprises three slots disposed apart from each other, and the hand tool set comprises three holding components.

16. The composite tool holder as claimed in claim 14, wherein the substrate comprises three slots disposed apart from each other, and the hand tool set comprises three holding components.

17. The composite tool holder as claimed in claim 1, wherein the substrate comprises a receiving hole formed through the substrate, and the holding portion of the holding component comprises two holding protrusions near inner surfaces of two free ends of the holding component respectively.

18. The composite tool holder as claimed in claim 16, wherein the substrate comprises a receiving hole formed through the substrate, and the holding portion of the holding component comprises two holding protrusions near inner surfaces of two free ends of the holding component respectively.

19. The composite tool holder as claimed in claim 2, wherein each positioning block comprises:

an engaging portion engaging in the sliding slot and abutting the abutting portion of the positioning plate; and an inserting portion formed on a top surface of the engaging portion and extending out of the upper opening of the first track, and the inserting portion comprising a resilient constraining protrusion formed on an outer surface of the inserting portion.

20. The composite tool holder as claimed in claim 18, wherein each positioning block comprises:

an engaging portion engaging in the sliding slot and abutting the abutting portion of the positioning plate; and an inserting portion formed on a top surface of the engaging portion and extending out of the upper opening of the first track, and the inserting portion comprising a resilient constraining protrusion formed on an outer surface of the inserting portion.

* * * * *